US011235839B2

(12) United States Patent
Cassañas et al.

(10) Patent No.: US 11,235,839 B2
(45) Date of Patent: Feb. 1, 2022

(54) BOAT COMPRISING AN INFLATABLE SUPPORT

(71) Applicant: ZODIAC MILPRO INTERNATIONAL, Paris (FR)

(72) Inventors: Marc Cassañas, Paris (FR); Guillaume Lacoste, Paris (FR)

(73) Assignee: ZODIAC MILPRO INTERNATIONAL, Paris (FR)

( * ) Notice: Subject to any disclaimer, the term of this patent is extended or adjusted under 35 U.S.C. 154(b) by 0 days.

(21) Appl. No.: 16/857,521

(22) Filed: Apr. 24, 2020

(65) Prior Publication Data

US 2020/0339222 A1 Oct. 29, 2020

(30) Foreign Application Priority Data

Apr. 25, 2019 (FR) ..... 19 04387

(51) Int. Cl.
*B63B 7/08* (2020.01)

(52) U.S. Cl.
CPC ..... *B63B 7/085* (2013.01); *B63B 7/082* (2013.01)

(58) Field of Classification Search
CPC ..... B63B 7/08; B63B 7/082; B63B 7/085; B63B 7/087; B63C 2009/042
See application file for complete search history.

(56) References Cited

U.S. PATENT DOCUMENTS 4,545,319 A * 10/1985 Ferronniere ..... B63B 7/082 114/345
4,678,443 A * 7/1987 Edwards ..... B63C 9/04 441/38
8,789,486 B2 * 7/2014 Boudeau ..... B63B 7/082 114/345
2002/0049017 A1 * 4/2002 Ross ..... B63B 7/08 441/132
2020/0148307 A1 * 5/2020 Cassanas ..... B63B 7/08

FOREIGN PATENT DOCUMENTS

EP 1900626 A1 3/2008
FR 2422135 A1 11/1979
FR 3066751 A1 11/2018

OTHER PUBLICATIONS

French Search Report, dated Dec. 18, 2019, from corresponding French application No. 19 04387.

* cited by examiner

*Primary Examiner* — Ajay Vasudeva
(74) *Attorney, Agent, or Firm* — Nixon & Vanderhye

(57) ABSTRACT

Disclosed is a boat including a bottom bordered radially externally by a wall which includes an inflatable and foldable front wall, an inflatable and foldable side wall, and a rear wall. The boat includes at least one inflatable and foldable longitudinal support parallel to the side wall, the support including an inflatable tube and a foldable upper connection which connects the tube to the upper part of the side wall, the upper connection extending longitudinally along the side wall and forming during use a surface P capable of receiving an element.

10 Claims, 3 Drawing Sheets

[Fig. 1]
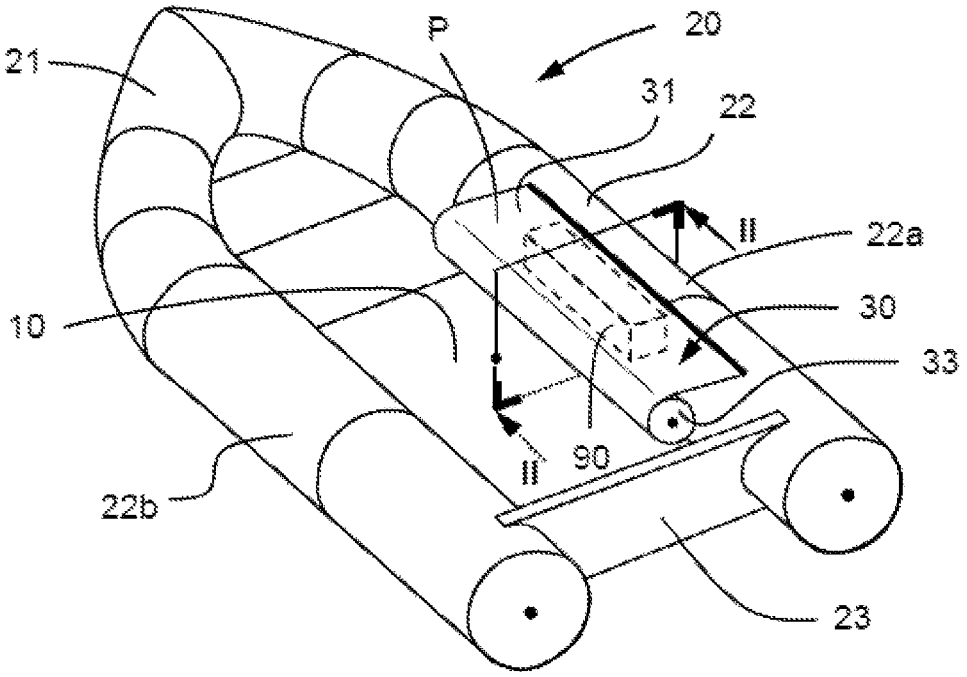
[Fig. 2]
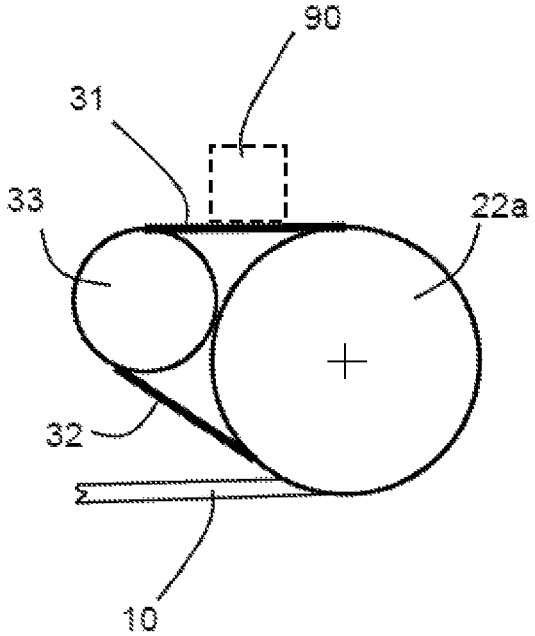

[Fig. 3]
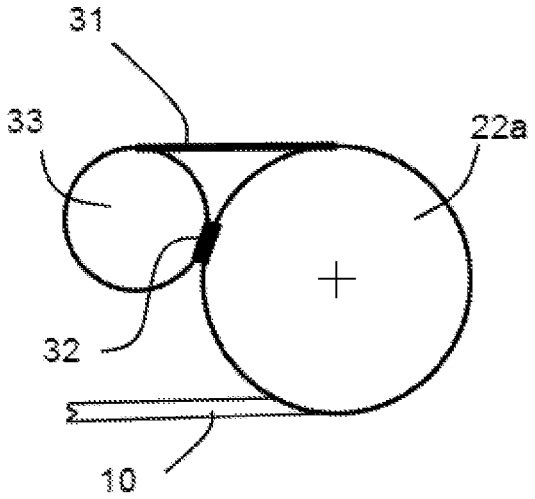
[Fig. 4]
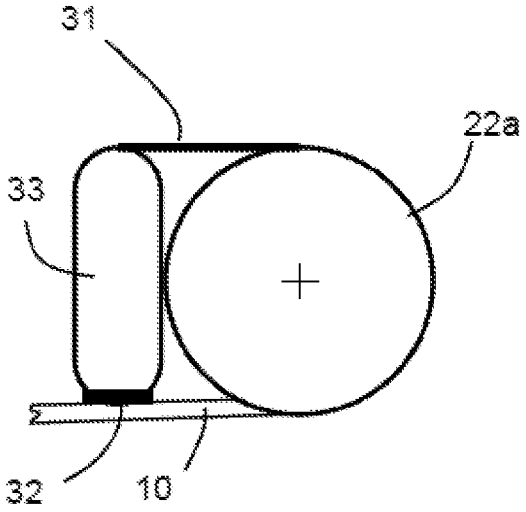

[Fig. 5]
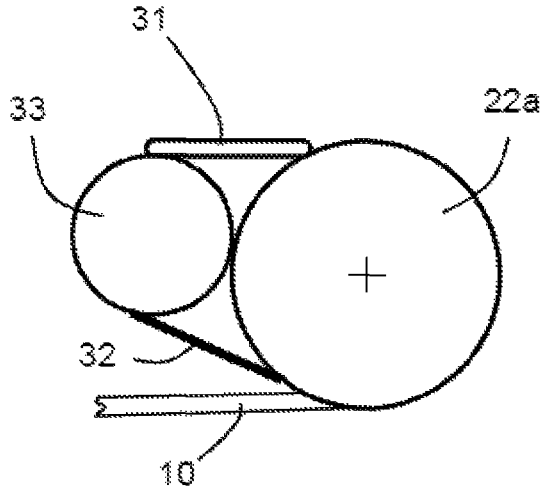
[Fig. 6]
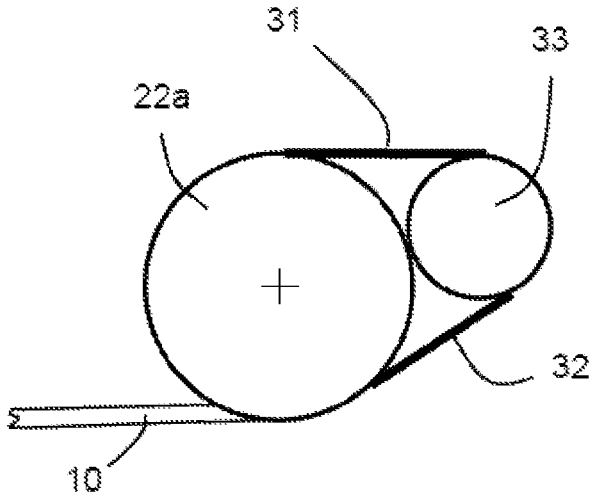

BOAT COMPRISING AN INFLATABLE SUPPORT

BACKGROUND OF THE INVENTION

Field of the Invention

The present invention relates to a boat comprising a bottom bordered radially externally by a wall which comprises an inflatable and foldable front wall, an inflatable and foldable side wall, and a rear wall.

Description of the Related Art

Such boats have the advantages of being significantly lighter in comparison to a boat of the same size with a rigid hull, and of occupying little space when not in use. Indeed, the front and side walls are inflatable and foldable, each forming a tube of circular cross-section filled with air. The bottom (floor) of the boat is either foldable (in the case of an inflatable/foldable boat) or rigid (in the case of a semi-rigid boat).

In the following description, the terms "internal"/"interior"/"inside" and "external"/"exterior"/"outside" are defined with respect to the geometric center of the boat once inflated.

The terms "lower"/"upper" are defined with respect to the vertical axis, which is perpendicular to the bottom of the boat which extends in a horizontal plane during normal use of the boat. This vertical axis is perpendicular to the running surface during normal use of the boat.

During use, boat passengers can sit inside the boat, and/or on the front and side walls. However, it would be useful and advantageous to have a horizontal surface in the boat capable of receiving a seated passenger, on which an object can be placed/transported, or else on which passengers can walk to embark/disembark, while allowing the boat to retain its initial folding or semi-rigid nature to the maximum extent.

SUMMARY OF THE INVENTION

The present invention aims to remedy these disadvantages.

The invention aims to provide a boat which has additional surface area capable of being a support for receiving one or more passengers and/or one or more objects, in other words an element.

This aim is achieved due to the fact that the boat comprises at least one inflatable and foldable longitudinal support parallel to the side wall, the support comprising an inflatable tube and a foldable upper connection which connects the tube to the upper part of the side wall, the upper connection extending longitudinally along the side wall and forming during use a flat surface capable of receiving an element.

With these arrangements, the boat comprises a support which is capable of receiving a non-zero weight, for example one or more passengers or objects. The inflatable and foldable nature of the support allows the boat to retain its initial inflatable or semi-rigid character, meaning that the support does not contribute to the rigidity of the boat.

For example, the upper connection is a flexible membrane.

For example, the upper connection is an inflatable part.

Advantageously, the flat surface formed during use by the upper connection is substantially horizontal.

The support is thus more suitable for serving as a support for an element, meaning an object, animal, or person.

Advantageously, the support is located on the inside and/or outside of the boat relative to said side wall.

The upper part of the side wall is thus kept free.

Advantageously, the support further comprises at least one lower connection which connects the tube to the side wall.

The support is thus better held against the side wall.

Advantageously, the one or more connections between the tube and the side wall are removable, such that the tube is removable relative to the side wall.

The functionalities and arrangement possibilities of the support surfaces of the boat are thus increased.

Advantageously, the bottom of the boat is foldable.

BRIEF DESCRIPTION OF THE DRAWINGS

The invention will be best understood and its advantages most apparent from reading the following detailed description of some embodiments provided as non-limiting examples. The description refers to the accompanying drawings in which:

FIG. 1 is a perspective view of a boat according to the invention;

FIG. 2 is a sectional view of a side part of a boat according to the invention along line II-II of FIG. 1;

FIG. 3 is a sectional view of a side part of an alternative to the embodiment of FIG. 2;

FIG. 4 is a sectional view of a side part of yet another embodiment of a boat according to the invention;

FIG. 5 is a sectional view of a side part of yet another embodiment of a boat according to the invention; and FIG. 6 is a sectional view of a side part of yet another embodiment of a boat according to the invention.

DESCRIPTION OF THE PREFERRED EMBODIMENTS

FIG. 1 is a perspective view of a boat comprising a bottom 10 bordered radially externally by a wall 20 which comprises an inflatable and foldable front wall 21, an inflatable and foldable side wall 22, and a rear wall 23. For example, the rear wall 23 is rigid.

The side wall 22 consists of a port side wall 22*b* and a starboard side wall 22*a* parallel to the port side wall 22*b*.

The bottom 10 may be rigid (in the case of a semi-rigid boat) or foldable.

The boat comprises an inflatable and foldable longitudinal support 30 which extends parallel to the side wall 22, the support 30 comprising an inflatable tube 33 and a foldable upper connection 31 which connects the tube 33 to the upper part of the side wall 22.

The upper connection 31 is thus either a membrane or an inflatable part.

During use, the upper connection 31 is under tension and it defines a flat surface P extending longitudinally along the side wall 22 and forming a surface capable of receiving and supporting an element 90.

This element 90 has a non-zero weight, and is either an object such as goods, a person, or an animal.

In the case of a person, the surface acts as a bench on which the person can sit or walk. The surface can also serve as a stretcher.

Depending on the conformation of the upper connection 31, and of the lower connection 32 if there is such (see below), the flat surface P is horizontal or inclined relative to the horizontal.

The fact that the support 30 is inflatable and foldable allows the boat to retain its at least partially inflatable character. It also makes it possible to reduce the volume and to retract the support 30 in situations where the support 30 is not used.

For example, the tube 33 has a cylindrical shape with a circular cross-section.

This embodiment is illustrated in FIG. 1, and in FIG. 2 which is a partial cross-section of FIG. 1 and which illustrates the starboard side wall 22*a* and the support 30.

The support 30 further comprises a foldable lower connection 32 which connects the tube 33 to another part of the boat.

For example, as represented in FIG. 2, the lower connection 32 connects the tube 33 to the lower part of the starboard side wall 22*a*, therefore of the side wall 22.

The lower connection 32 is thus either a membrane (flexible membrane) or an inflatable part.

The upper connection 31 connects the upper part of the tube 33 to the upper part of the starboard side wall 22*a* and is under tension. The lower connection 32 connects the lower part of the tube 33 to the lower part of the starboard side wall 22*a* and is under tension. The tube 33 is therefore pressed and held against the starboard side wall 22*a* by the upper connection 31 and the lower connection 32. The area of contact between the tube 33 and the starboard side wall 22*a* is therefore located between the upper connection 31 and the lower connection 32.

The retention of the tube 33 is more effective due to this double connection.

The attachment between the upper connection 31 or the lower connection 32 on the one hand, and the tube 33 or the starboard side wall 22*a* on the other hand, is achieved by any suitable means, for example by permanent attachments (seam, glue) or by removable attachments (velcro strips, rope passing through eyelets distributed longitudinally along the upper connection 31 or the lower connection 32 on the one hand, and along the tube 33 or the starboard side wall 22*a* on the other hand).

Advantageously, at least one of the attachments of the upper connection 31 and at least one of the attachments of the lower connection 32 is removable. The tube 33 is thus removable relative to the starboard side wall 22*a*.

Illustrated in FIG. 3 is a variant of the configuration in FIG. 2. The lower connection 32 is located at the area of contact between the tube 33 and the starboard side wall 22*a*.

The tube 33 may have any shape, other than cylindrical with a circular cross-section.

For example, the tube 33 is shaped so that, when inflated, it has an oblong cross-section elongated in the vertical direction, such that the tube 33 touches the bottom 10. For example, a lower connection 32 connects the tube 33 to the bottom 10.

This embodiment is illustrated in FIG. 4.

The tube 33 also touches the starboard side wall 22*a*. Additionally or alternatively, a lower (additional) connection 32 connects the tube 33 and the starboard side wall 22*a* at their area of contact.

Illustrated in FIG. 5 is a variant of the configuration in FIG. 2. The upper connection 31 is an inflatable part which is shaped so that, once inflated, it has an oblong cross-section elongated in the horizontal direction. The upper connection 31 is fixed at one of its ends to the upper part of the starboard side wall 22*a*. The tube 33 has for example a circular cross-section and is fixed to the other end of the upper connection 31.

The lower connection 32 connects the lower part of the tube 33 to the lower part of the starboard side wall 22*a*. The tube 33 is therefore pressed and held against the starboard side wall 22*a* by the upper connection 31 and the lower connection 32. The area of contact between the tube 33 and the starboard side wall 22*a* is therefore located between the upper connection 31 and the lower connection 32.

Additionally or alternatively, an (additional) lower connection 32 connects the tube 33 and the starboard side wall 22*a* at their area of contact.

Thus, advantageously, the support 30 further comprises at least one lower connection 32 which connects the tube 33 to the side wall 22, which allows better securing the tube 33 to the side wall 22.

In the above description, the support 30 has been described as connected to the side wall 22 while being located within the interior space of the boat. The upper connection 31, and if present the one or more lower connections 32, are then located within the interior space of the boat.

Alternatively, the tube 33 is connected to the side wall 22 so that it is located outside the boat.

This embodiment is illustrated in FIG. 6.

The support 30 is thus located outside the boat. The upper connection 31, and if present the one or more lower connections 32, are connected to the side wall 22 as described above in the case where the support 30 is located within the interior space of the boat. The difference from the cases where the support 30 is located inside the boat is that the upper connection 31 and the one or more lower connections 32 are connected to the exterior part of the surface of the side wall 22 relative to the center of the boat, instead of being connected to the interior part of the surface of the side wall 22.

This configuration increases the seating area of the boat while keeping the interior space of the boat available.

In the above description, the support 30 has been described as connected to the starboard side wall 22*a*.

Additionally or alternatively, the port side wall 22*b* also carries a support 30, distinct from the support 30 connected to the starboard side wall 22*a*.

The support 30 may also extend beyond the side wall 22, along the front wall 21 to the bow of the boat. In this case, the support 30 can serve as a support surface for a passenger when disembarking and/or embarking.

These configurations make it possible to increase the surface area of the support 30 capable of receiving an element 90.

Advantageously, in all cases, the support 30 is located inside and/or outside the boat relative to the side wall 22, and the upper connection 31 is fixed to the upper part of the side wall 22 or the upper part of the front wall 21 so as to leave free the top of this upper part. This upper part is thus free to access and is able to support an element.

In general, the boat may comprise several separate supports 30, located inside and/or outside the boat, on the starboard side wall 22*a* and/or on the port side wall 22*b* and/or on the front wall 21. These supports 30 may for example be any of the supports 30 described above.

The invention claimed is:

1. A boat comprising a bottom (10) bordered radially externally by a wall (20) which comprises an inflatable and foldable front wall (21), an inflatable and foldable side wall (22), and a rear wall (23), said boat comprising at least one inflatable and foldable longitudinal support (30) parallel to said side wall (22), said support (30) comprising an inflatable tube (33) and a foldable upper connection (31) which connects said tube (33) to an upper part of said side wall (22), said upper connection (31) extending longitudinally along said side wall (22) and forming during use a flat surface (P) capable of receiving an element (90), wherein said upper connection (31) is an inflatable part.

2. The boat according to claim 1, wherein the flat surface (P) formed during use by said upper connection (31) is substantially horizontal.

3. The boat according to claim 2, wherein said at least one support (30) is located on the inside and/or outside of the boat relative to said side wall (22).

4. The boat according to claim 2, wherein said support (30) further comprises at least one lower connection (32) which connects said tube (33) to said side wall (22).

5. The boat according to claim 1, wherein said at least one support (30) is located on the inside and/or outside of the boat relative to said side wall (22).

6. The boat according to claim 5, wherein said support (30) further comprises at least one lower connection (32) which connects said tube (33) to said side wall (22).

7. The boat according to claim 1, wherein said support (30) further comprises at least one lower connection (32) which connects said tube (33) to said side wall (22).

8. The boat according to claim 7, wherein said upper connection (31) and said lower connection (32) between said tube (33) and said side wall (22) are removable, such that said tube (33) is removable relative to said side wall (22).

9. The boat according to claim 1, wherein said upper connection (31) between said tube (33) and said side wall (22) is removable, such that said tube (33) is removable relative to said side wall (22).

10. The boat according to claim 1, wherein said bottom (10) is foldable.

* * * * *